US006584928B2

(12) United States Patent
Kinahan

(10) Patent No.: US 6,584,928 B2
(45) Date of Patent: Jul. 1, 2003

(54) APPARATUS FOR SUPPORTING A BANNER UNFURLED

(76) Inventor: Brian Kinahan, 49 Hickory Hill Rd., Simsbury, CT (US) 06070

( * ) Notice: Subject to any disclaimer, the term of this patent is extended or adjusted under 35 U.S.C. 154(b) by 0 days.

(21) Appl. No.: 09/905,776

(22) Filed: Jul. 14, 2001

(65) Prior Publication Data

US 2002/0073914 A1 Jun. 20, 2002

Related U.S. Application Data

(63) Continuation of application No. 09/146,598, filed on Sep. 3, 1998, now Pat. No. 6,293,221.

(51) Int. Cl.[7] ..... G09F 17/00
(52) U.S. Cl. ..... 116/174; 40/591; 116/173
(58) Field of Search ..... 116/173, 28 R, 116/174, 209; 40/591, 666; 24/563, 545

(56) References Cited

U.S. PATENT DOCUMENTS

| | | | | | |
|---|---|---|---|---|---|
| 1,002,260 | A | * | 9/1911 | Golden | 116/173 |
| 1,195,224 | A | * | 8/1916 | Hoffman | 116/174 |
| 1,294,032 | A | * | 2/1919 | Bixby | 116/173 |
| 1,296,072 | A | * | 3/1919 | Gilespie | 116/173 |
| 1,804,293 | A | * | 5/1931 | Warzoha | 116/173 |
| 2,072,573 | A | * | 3/1937 | Vigliotti | 116/173 |
| 2,168,484 | A | * | 8/1939 | Loux | 116/173 |
| 2,368,783 | A | * | 2/1945 | Schillinger | 116/174 |
| 2,764,122 | A | * | 9/1956 | Irvin | 116/173 |
| 2,856,891 | A | * | 10/1958 | Solomon | 116/173 |
| 2,905,140 | A | * | 9/1959 | Acklam | 116/173 |
| 2,909,147 | A | * | 10/1959 | Crowder | 116/173 |
| 3,024,552 | A | * | 3/1962 | MacLea | 116/28 R |
| 3,075,492 | A | * | 1/1963 | Winfrey | 116/173 |
| 3,495,568 | A | * | 2/1970 | Palinkos | 116/173 |
| 3,500,789 | A | * | 3/1970 | Keats | 116/173 |
| 3,636,912 | A | * | 1/1972 | Kamp | 116/173 |
| 3,762,360 | A | * | 10/1973 | Hawes | 116/173 |
| 4,024,833 | A | * | 5/1977 | Pook et al. | 116/173 |
| 4,526,820 | A | * | 7/1985 | Haas | 116/28 R |
| 4,574,726 | A | * | 3/1986 | Sullivan | 116/128 R |
| 4,601,255 | A | * | 7/1986 | Marcotti | 116/173 |
| 4,700,655 | A | * | 10/1987 | Kirby | 116/174 |
| 4,875,431 | A | * | 10/1989 | Dobosz | 116/173 |
| 5,042,418 | A | * | 8/1991 | Hoover et al. | 116/173 |
| 5,267,524 | A | * | 12/1993 | Maxwell | 116/174 |
| 5,402,746 | A | * | 4/1995 | Deschamps | 116/174 |
| 5,517,941 | A | * | 5/1996 | Fisher | 116/173 |
| 5,665,438 | A | * | 9/1997 | Lee et al. | 280/727 |
| 5,884,424 | A | * | 3/1999 | Smith | 40/610 |
| 6,293,221 | B1 | * | 9/2001 | Kinahan | 116/174 |

FOREIGN PATENT DOCUMENTS

JP 8-221020 8/1996

* cited by examiner

*Primary Examiner*—Diego Gutierrez
*Assistant Examiner*—Tania C. Courson
(74) *Attorney, Agent, or Firm*—Cantor Colburn LLP

(57) ABSTRACT

A banner and support assembly for supporting a banner or flag to a vertical rod, such as a motor vehicle antenna, in an unfurled state at all times. The assembly includes a banner formed of cloth or other flexible material and a banner support for attaching the banner for receiving the antenna, and a horizontal sleeve disposed at the upper edge of the banner for receiving the banner support. The support includes a vertical clip portion and a horizontal arm disposed at the upper end of the clip portion. The clip portion is generally C-shaped having an inner diameter less than the outer diameter of the antenna to receive the banner and antenna to frictionally clamp the banner to the antenna. The arm portion of the support extends through the horizontal sleeve of the banner to maintain the banner in the unfurled state at all times. In the alternative the banner support may include a C-shaped clip and an L-shaped extension formed of flexible, formstable sheet material. The L-shaped member includes an arm that extends within the horizontal sleeve of the banner to maintain the banner in an unfurled state, yet allows the banner to naturally wave in the wind. The clip secures the banner and L-shaped member to the antenna.

17 Claims, 6 Drawing Sheets

APPARATUS FOR SUPPORTING A BANNER UNFURLED

CROSS REFERENCE TO RELATED APPLICATION

This application is a continuation of U.S. patent application Ser. No. 09/146,598 filed Sep. 3, 1998, now U.S. Pat. No. 6,293,221, the contents of which are incorporated herein by reference thereto.

FIELD OF THE INVENTION

The present invention relates to banners, and more particularly to an apparatus for supporting banners to a vertical rod, such as a motor vehicle antenna, in an unfurled state.

BACKGROUND OF THE INVENTION

Many type of devices are known in the art to display banners to an antenna of a motor vehicle. These banners may display indicia or symbols expressing one's support for a political candidate, personal cause or sports team. The banner may also include a flag of a particular nation or advertisement for a business. The prior art describes a number of devices for supporting and displaying such banners on an automobile antenna in a natural and unfurled state when the automobile is stationary.

For example, U.S. Pat. Nos. 2,909,147 to Crowder and 4,875,431 to Dobosz show flag attaching means for supporting a flag to a motor vehicle antenna. The attaching means includes a clip for securing the flag, made of cloth or other flexible sheet material, to the antenna. While the flag is free to wave in the wind to provide a natural display of the flag when the motor vehicle is moving or when the wind is blowing, the flexible flag does not remain in the unfurled state when no wind is present, resulting in the covering of the indicia or symbols imprinted on the flag.

Other examples for supporting pennants to an automobile antenna further include U.S. Pat. Nos. 2,905,140 to Acklam and 2,856,891 to Soloman. These pennants and support means overcome the disadvantage of the flag attaching means described hereinbefore by providing a flag or pennant formed of rigid material so that the indicia disposed on the pennant is readily visible at all times even when no wind is present. The pennants, however, appear as signs attached to the antenna rather than free waving flags.

U.S. Pat. Nos. 4,024,833 to Pook et al. and 4,700,655 to Kirby show a sign and flag support wherein the flag includes a vertical and upper horizontal sleeve for receiving a vertical rod and a horizontal rod, respectively. The rods display a cloth-like flag in an unfurled state at all times, however, the support apparatus is complex and unique, and therefore not easily transferrable to various vertical rods or antennas.

SUMMARY OF THE INVENTION

This invention offers advantages and alternatives over the prior art by providing a banner and banner support assembly having a banner support comprising a vertical clip portion and a horizontal arm portion for supporting and displaying a banner or flag to an antenna in an unfurled state at all times. The banner includes a vertical sleeve at one edge of the banner for receiving the antenna, and a horizontal sleeve for receiving the horizontal arm portion of the support. Advantageously, the assembly may be easily clipped to an antenna in an unfurled state. The minimal support to maintain the banner in the unfurled state also allows the banner to be displayed in a substantially natural state, permitting the banner to wave in the wind. Further, the clip allows the banner assembly to the easily secured to the antenna at any desired height.

According to the present invention, a banner and support assembly for securing a banner to a vertical rod comprises a banner having a vertical sleeve disposed along a side edge of the banner and a second horizontal sleeve disposed along an upper edge. A banner support secures the banner to the vertical rod. The banner support includes a clip for clamping the banner to the vertical rod and an arm extending from an upper end of the clip. The arm extends through a predetermined portion of the second sleeve of the banner to consistently display the banner unfurled. Preferably the clip is generally C-shaped and frictionally engages the vertical rod. The arm may be integrally formed to the upper end of the clip. Alternatively, the arm may be form of a generally L-shaped wire having one end engaging the clip and a second end for supporting the upper edge of the banner. The banner support may comprise a clip and an arm formed of generally L-shaped flexible, formstable sheet material.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
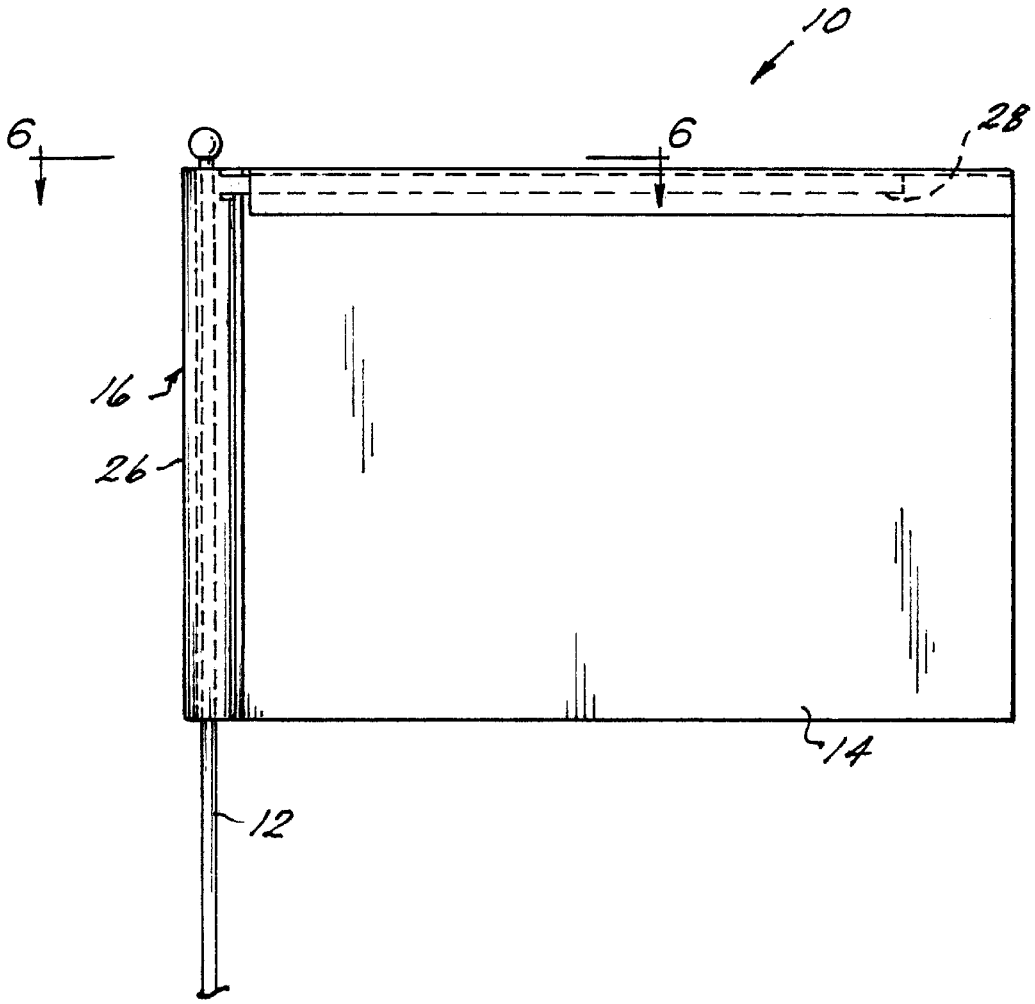
FIG. 1 shows a front elevational view of a banner and banner support assembly according to a preferred embodiment of the present invention attached to an antenna.
Figure 2:
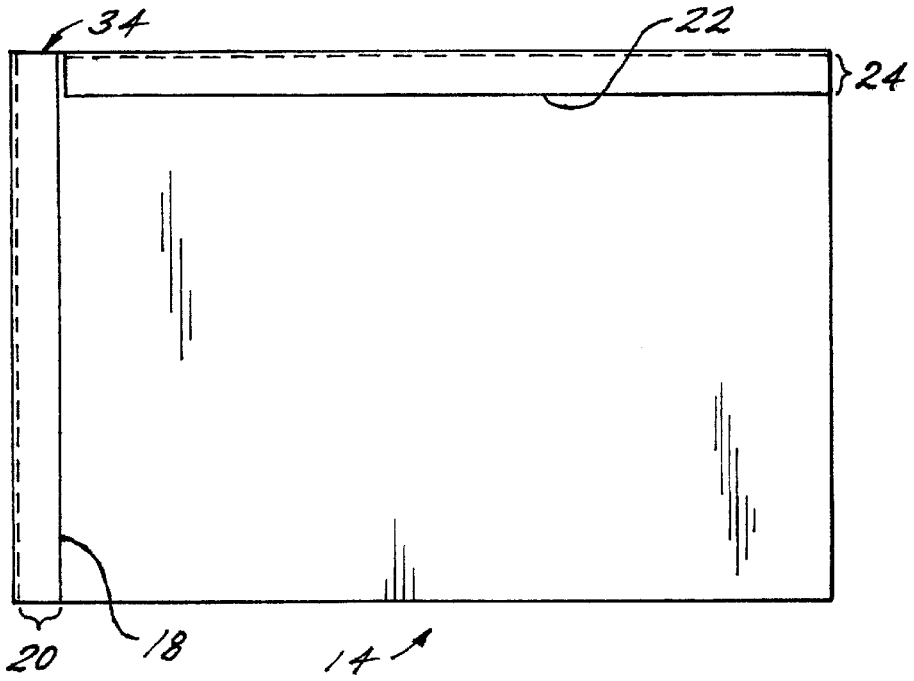
FIG. 2 shows a front elevational view of a banner of FIG. 1.

Referring to FIG. 1, a banner and support assembly, generally designated 10, is shown clipped to vertical rod 12 (i.e., an automobile antenna). The assembly 10 includes a banner or flag 14 and a banner support 16 for supporting the banner in an unfurled state at all times. As best shown in FIG. 2, the banner 14 has a generally rectangular shape having a side edge 18 of the banner 14 folded over and attached to the banner to form first sleeve, herein referred to as a vertical sleeve 20, for receiving the antenna 12. Further, a portion of the upper edge 22 of the banner 14 is folded inwardly and attached to the banner to form a second sleeve, herein referred to as a horizontal sleeve 24, for receiving the support 16, as will be described in further detail hereinafter. While the banner 14 is shown generally rectangular, one will appreciate that the banner may be any shape (i.e., triangular) provided the upper edge 22 of the banner includes the horizontal sleeve 24.

Figure 3:
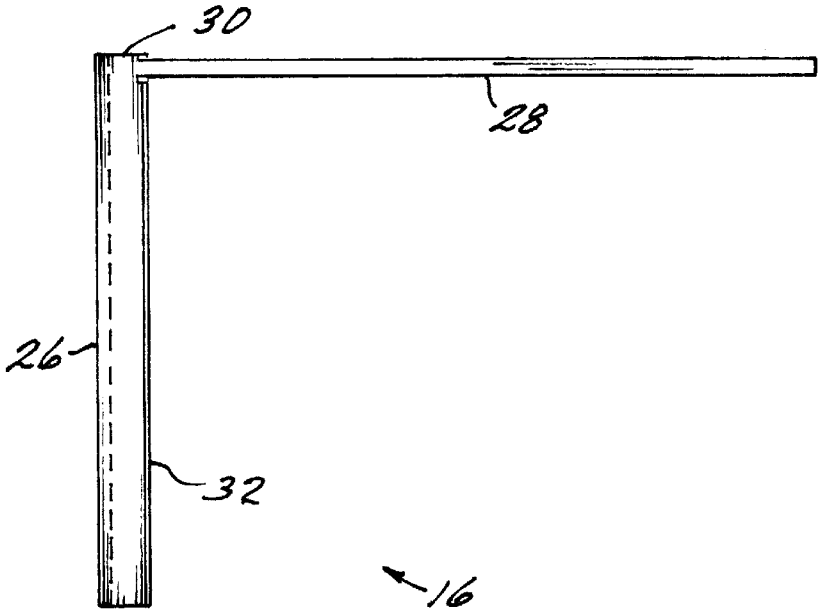
FIG. 3 shows a front elevational view of a banner support of FIG. 1.
Figure 4:
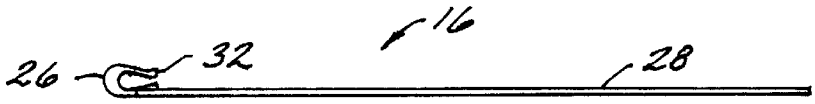
FIG. 4 shows a t op plan view of the banner support of FIG. 3.
Figure 5:
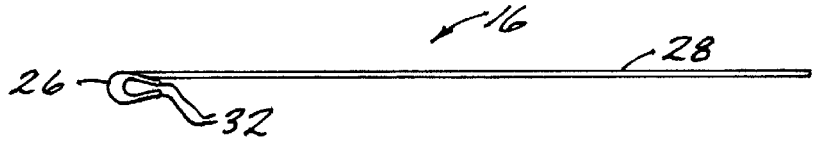
FIG. 5 shows a bottom plan view of the banner support of FIG. 3.

Referring to FIGS. 3–5, the banner support 16 includes a vertical clip portion 26 and an integral support member, herein referred to as a horizontal arm 28, extending from the upper end 30 of the clip portion. As best shown in FIGS. 4 and 5, the clip portion 26 is generally C-shaped for securing the banner 14 and the banner support 16 to the antenna 12. The outer edges 32 of the clip portion are flared outwardly to form flanges thus easing the insertion of the antenna 12 into the clip portion 26. The inner diameter of the clip portion is slightly less than the outer diameter of the antenna 12. The banner support 16 is formed of resilient flexible material, preferably polymeric material, to provide a clamping action to the antenna. The horizontal arm 28 extends sufficiently in the horizontal sleeve 24 of the banner 14 to ensure the banner is displayed unfurled.

Figure 6:
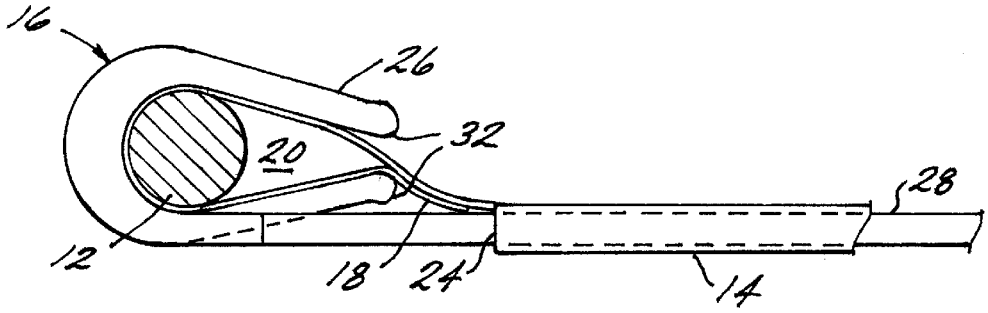
FIG. 6 shows a cross-sectional, top plan view of the banner and banner support assembly of FIG. 1 taken along the line 6—6.

In the assembly of the banner and support assembly 10, as shown in FIG. 6, the banner 14 is first fitted onto the antenna 12, whereby the antenna passes through the vertical sleeve 20. The upper end 34 (see FIG. 2) of the vertical sleeve 20 may be open to permit the antenna 12 to pass fully through the vertical sleeve, thus allowing the banner and support assembly 10 to be disposed at any desired height along the antenna. Further the opened ended vertical sleeve 20 permits a plurality of banners to be displayed on a single antenna. In the alternative, the upper end 34 of the vertical sleeve 20 may be closed to prevent the antenna from passing fully through the vertical sleeve, and thereby retain the banner and support assembly 10 at the top of the antenna 12. After the banner 14 is located at the desired height on the antenna 12, the horizontal arm of the banner support 16 is inserted within the horizontal sleeve 24 of the banner 14. The horizontal arm 28 is fully inserted into the banner 14 until the curved ends 32 of the clip portion 26 of the banner support 16 engages the antenna 12 and vertical sleeve 20. The clip portion 26 of the support 16 is forced against the antenna 12 covered by the vertical sleeve 20, spreading the ends 32 of the clip portion apart to receive the antenna. The ends 32 of the resiliently flexible clip portion 26 then closes to frictionally clamp the banner 14 to the antenna 12.

Advantageously, the present invention provides a banner support 16 that displays the banner 14 in an unfurled state to permit display of the indicia or design on the banner whether the automobile is moving or stationary. The banner support 16 supports only one side edge 18 and the upper edge 22 of the banner 14 to thereby allow a substantial portion of the banner to wave in the wind, thus providing a natural display of the flag. Further, the banner support 16 enables the banner to be secured at any height along the antenna 12.

Figure 7:
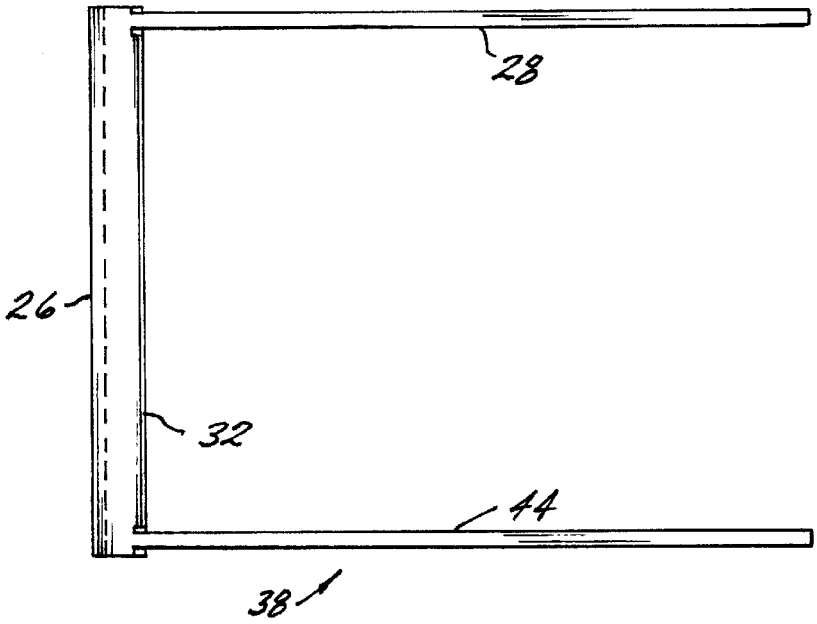
FIG. 7 shows a front plan view of an alternative embodiment of a banner support of FIG. 1.
Figure 8:
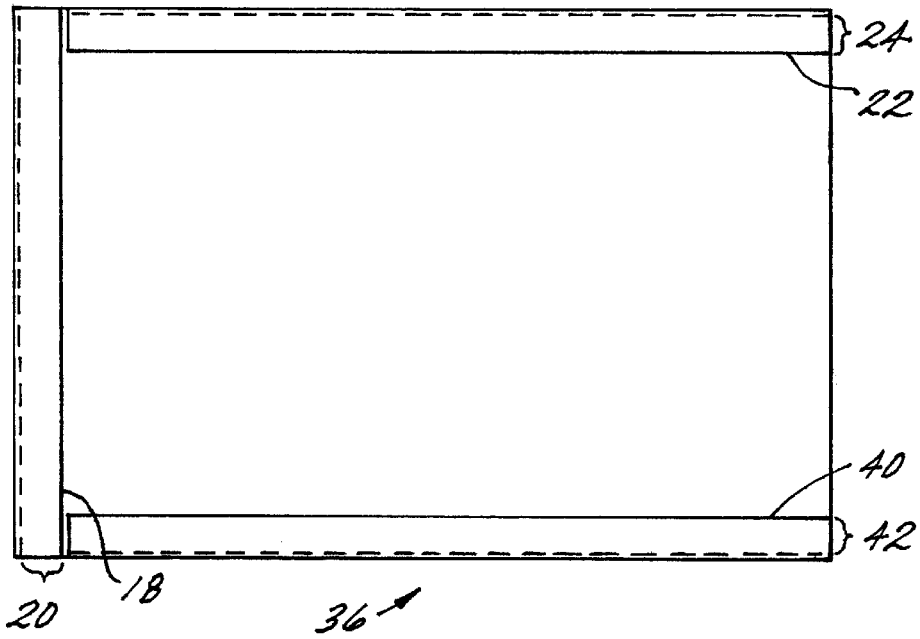
FIG. 8 shows a front plan view of an alternative embodiment of a banner of FIG. 1.

An alternative embodiment of the banner and banner support assembly 10 is shown in FIGS. 7 and 8. The banner 36 is substantially the same as the banner 14 of FIG. 2 and further includes a lower edge 40 folded inwardly and attached to the banner 36 to form a third sleeve, herein referred to as a lower horizontal sleeve 42. Further, the banner support 38 is substantially the same as the banner support 16 of FIG. 3, but further includes a second horizontal arm 44 extending from a lower end of the vertical clip portion 26. The lower horizontal arm 44 in the assembly of the banner 36 and support 38 is inserted within the lower horizontal sleeve 42 of the banner 36.

Figure 9:
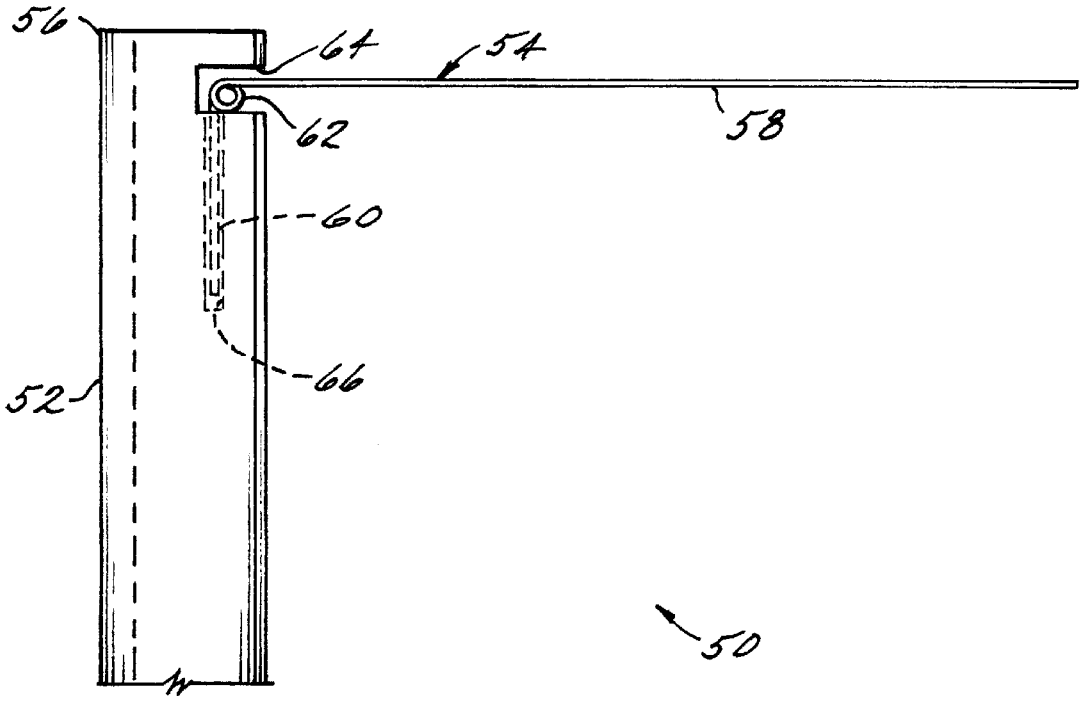
FIG. 9 shows a front plan view of a second alternative embodiment of a banner support of FIG. 1.

FIG. 9 illustrates an alternative embodiment of the banner support 16 for displaying the banner 14 of FIG. 2. The banner support 50 of FIG. 9 includes a clip 52, substantially similar to the clip portion 26 of the support 16 of FIG. 3, and an L-shaped wire 54 extending from the upper edge 56 of the clip. The wire 54 is formed by winding a wire a predetermined number of turns to form a vertical portion 60 and a horizontal portion 58, whereby a spring 62 is formed at the junction of the horizontal and vertical portions. The spring junction provides a spring action to the banner 14 secured to the horizontal portion 58 of the wire 54 to thereby permit the banner to more naturally move and wave in the wind. Further the spring 62 reduces the stress at the junction to increase the reliability and life of the banner support 54.

The L-shaped wire 54 is secured within a notch 64 disposed in the clip 52. The vertical portion 60 of the wire 54 is inserted within a bore 66 disposed longitudinally in a wall of the clip 52. The wire is free to rotate in the bore in the horizontal plane to further add to the natural action of the banner 14 in the wind.

Figure 10:
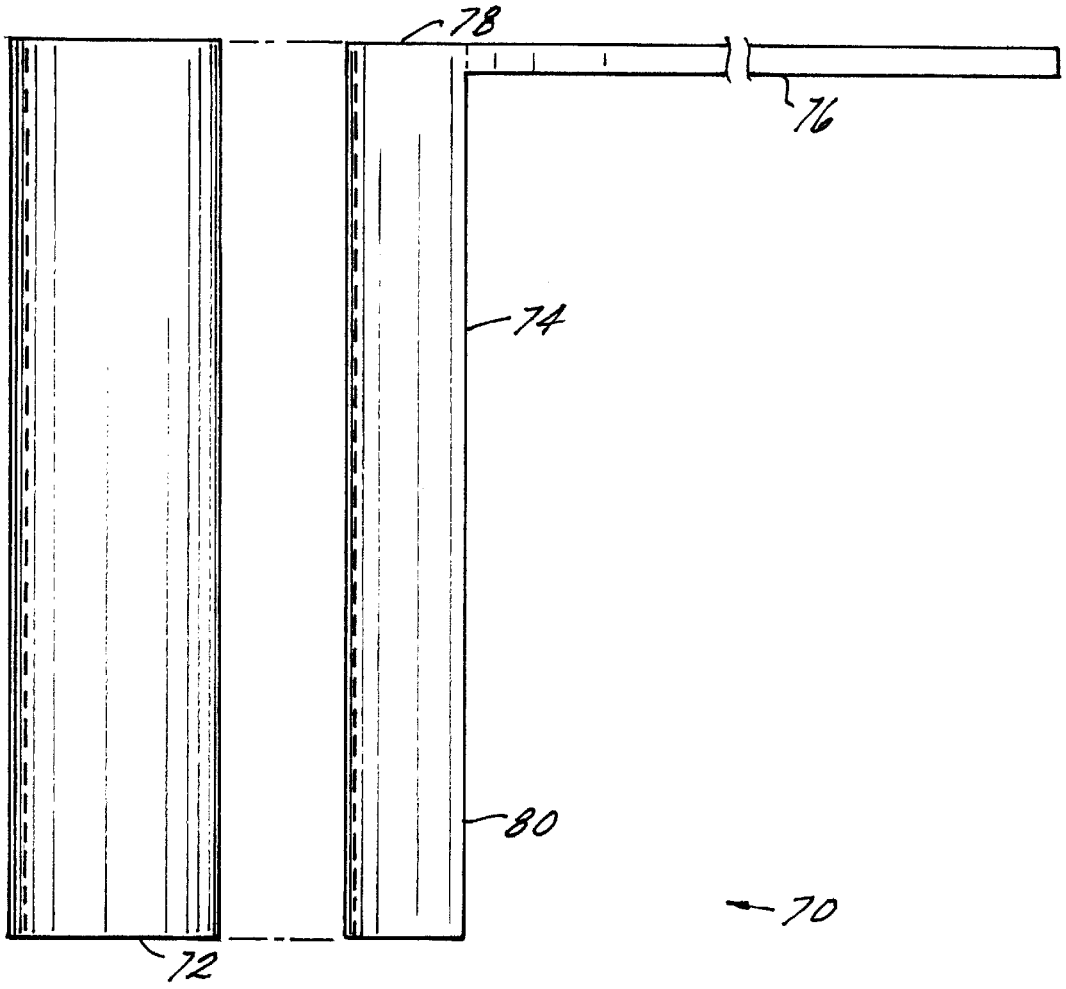
FIG. 10 shows an exploded, front elevational view of a third alternative embodiment of a banner support of the present invention.
Figure 11:
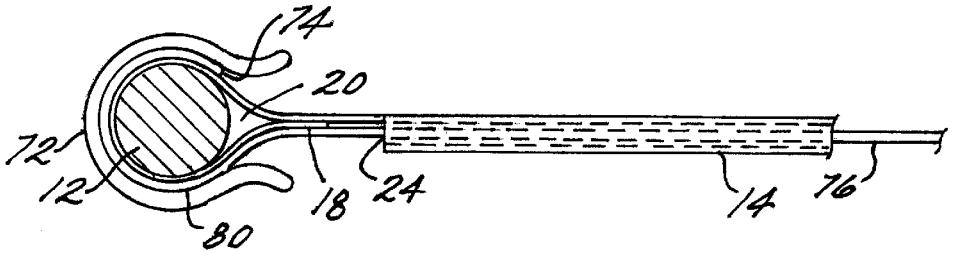
FIG. 11 shows a cross-sectional, top plan view of the third embodiment of the banner and banner support assembly of FIG. 1.

FIGS. 10 and 11 illustrate yet another alternative embodiment of the present invention for supporting and displaying the banner 14 of FIG. 1 in an unfurled state. Referring to FIG. 10, a banner support 70 includes a clip 72, similar to the clip portion 26 of the banner support 16 of FIG. 3, and a flexible formstable L-shaped extension 74 formed of flexible sheet material (i.e., polymeric sheet material). The L-shaped extension 74 includes a horizontal arm 76 extending from an upper end 78 of a vertical portion 80. Referring to FIG. 11, in the assembly of the banner 14 to the antenna, the banner is inserted onto the antenna 12 at the desired height. The horizontal arm 76 of the flexible L-shaped extension 74 is inserted fully into the upper sleeve 24 of the banner 14. The vertical portion 80 of the L-shaped extension is then wrapped around the vertical sleeve 20 of the banner 14 and the antenna 12. The clip 72 is then clamped over the vertical portion 80 of the extension 74 to secure the extension and the banner to the antenna. The flexible sheet material of the extension 74 provides sufficient support to maintained the banner 14 in an unfurled state, but sufficiently flexible to bent as the banner waves in the wind to provide a natural display of the banner.

While the banner and banner support assembly 10 of the present invention is shown attached to a vertical rod or antenna, one will appreciate that the assembly may be attached to an antenna disposed at varying angles.

While preferred embodiments have been shown and described, various modifications and substitutions maybe made thereto without departing from the spirit and scope of the invention. Accordingly, it is to be understood that the present invention has been described byway of illustration and not limitation.

What is claimed is:

1. A banner display and support apparatus, comprising:

a banner having a side edge, an upper edge, a first sleeve disposed at the side edge, and a second sleeve disposed at the upper edge;

a rod for displaying the banner, the rod being received in the first sleeve; and a clamp portion for frictionally clamping the banner to the rod such that the banner is releasably retained on the rod, the clamp portion continuously extending the length of the side edge and having a substantially U-shaped cross-section; and a support member extending from an upper end of the clamp portion in a direction perpendicularly from the clamp portion, the support member being received in the second sleeve and being formed integrally with the clamp portion.

2. The banner display and support apparatus of claim 1, wherein the first sleeve extends along an entire length of the side edge and the second sleeve extends along an entire length of the upper edge.

3. The banner display and support apparatus of claim 2, therein the banner is rectilinear in shape and is formed of a flexible material.

4. The banner display and support apparatus of claim 1, wherein the clamp portion includes a first flange disposed at a first edge and a second flange disposed at a second edge, the first and second flanges extending outwardly with respect to the rod to assist in said frictionally clamping the banner to the rod by facilitating an insertion of the rod into an interior of the clamp portion, the first and second flanges extending the length of the clamp portion.

5. The banner display apparatus of claim 4, wherein the first and second edges are pivotable about a longitudinal axis extending through a rear of the clamp portion, the clamp portion including an internal biasing force which returns the first and second edges to an original position when the first and second edges are pivoted from the original position.

6. The banner display and support apparatus of claim 5, wherein the rod pivots the first and second edges from the original position in a direction outwardly with respect to the rod and wherein the biasing forces clamp the first sleeve to the rod.

7. The banner display and support apparatus of claim 1, wherein said frictionally clamping the banner to the rod comprises the clamp portion wrapping the rod such that the entire first sleeve is held between the clamping portion and the rod.

8. The banner display and support apparatus of claim 1, further comprising a lower support member extending perpendicularly from a lower end of the clamping portion, the lower support member being received in a third sleeve disposed at a lower edge of the banner, the lower support member being formed integrally with the clamping member.

9. A banner display and support apparatus, comprising:

a banner having a side edge, an upper edge, a first sleeve disposed at the side edge, and a second sleeve disposed at the upper edge;

a rod for displaying the banner, the rod being received in the first sleeve;

a banner support including a flexible portion extending the length of the side edge disposed on and wrapped around the first sleeve, the banner support further including a support member extending from an upper end of the banner support in a direction perpendicularly from the banner support, the support member being received in the second sleeve and being formed integrally with the banner support; and a clamp portion for frictionally clamping the flexible portion and the first sleeve to the rod such that the banner is releasably retained on the rod, the clamp portion continuously extending the length of the side edge and having a substantially U-shaped cross-section.

10. The banner display and support apparatus of claim 9, wherein the first sleeve extends along an entire length of the side edge and the second sleeve extends along an entire length of the upper edge.

11. The banner display and support apparatus of claim 10, wherein the banner is rectilinear in shape and is formed of a flexible material.

12. The banner display and support apparatus of claim 9, wherein the clamp portion includes a first flange disposed at a first edge and a second flange disposed at a second edge, the first and second flanges extending outwardly with respect to the rod to assist in said frictionally clamping the banner to the rod by facilitating an insertion of the rod into an interior of the clamp portion, the first and second flanges extending the length of the clamp portion.

13. The banner display apparatus of claim 12, wherein the first and second edges are pivotable about a longitudinal axis extending through a rear of the clamp portion, the clamp portion including an internal biasing force which returns the first and second edges to an original position when the first and second edges are pivoted from the original position.

14. The banner display and support apparatus of claim 13, wherein the rod pivots the first and second edges from the original position in a direction outwardly with respect to the rod and wherein the biasing forces clamp the flexible portion and the first sleeve to the rod.

15. The banner display and support apparatus of claim 9, wherein said frictionally clamping the flexible portion and the first sleeve to the rod comprises the clamp portion wrapping the flexible portion such that the entire flexible portion is held between the clamping portion and first sleeve such that the first sleeve is held against the rod.

16. The banner display and support apparatus of claim 9, wherein the flexible portion comprises a material having a frictional property with respect to the first sleeve to facilitate engagement of the flexible portion and the first sleeve.

17. A banner support apparatus, comprising:

a banner having a side edge, an upper edge, a first sleeve disposed at the side edge, and a second sleeve disposed at the upper edge;

a vertical rod for displaying the banner, the vertical rod being received in the first sleeve; and a clamp portion for frictionally clamping the banner to the rod such that the banner is releasably retained on the rod, the clamp portion continuously extending the length of the side edge and having a substantially U-shaped cross-section; and a support member extending from an upper end of the clamp portion in a direction perpendicularly from the clamp portion, the support member being received in the second sleeve and being formed integrally with the clamp portion;

wherein, the clamp portion includes a first edge and a second edge extending the length of the clamp portion, the first and second edges being pivotable about a longitudinal axis extending the length of the clamp portion through a rear of the clamp portion, the clamp portion further including an internal biasing force which returns the first and second edges to an original position when the first and second edges are pivoted from the original position and wherein the rod is inserted into an interior of the clamp portion and pivots the first and second edges from the original position in a direction outwardly with the respect to the rod such that the biasing forces clamp the first sleeve to the rod.

* * * * *